US005454315A

United States Patent [19]

Lee

[11] Patent Number: 5,454,315

[45] Date of Patent: Oct. 3, 1995

[54] METHOD FOR PRODUCING A STAMP

[76] Inventor: Rong-Yuh Lee, No. 38, Min-Cheng Rd., San-Min Dist., Kaohsiung City, Taiwan

[21] Appl. No.: 299,837

[22] Filed: Sep. 1, 1994

[51] Int. Cl.[6] ..... B41K 1/34

[52] U.S. Cl. ..... 101/401.1; 101/211; 101/333

[58] Field of Search ..... 101/103, 109, 101/211, 327, 333, 334, 368, 372, 379, 401.1

[56] References Cited

U.S. PATENT DOCUMENTS

| | | | |
|---|---|---|---|
| 3,442,209 | 5/1969 | Funahashi | 101/327 |
| 3,478,682 | 11/1969 | Funahashi | 101/368 |
| 3,880,079 | 4/1975 | Klapholz | 101/334 |
| 4,306,498 | 12/1981 | Fujimura | 101/333 |
| 4,325,179 | 4/1982 | Werwa | 101/327 |

FOREIGN PATENT DOCUMENTS

| | | | |
|---|---|---|---|
| 2847524 | 5/1980 | Germany | 101/368 |
| 111915 | 9/1979 | Japan | 101/327 |

*Primary Examiner*—Stephen Funk

*Attorney, Agent, or Firm*—Willian Brinks Hofer Gilson & Lione

[57] ABSTRACT

A method for producing a stamp includes the following steps: (1) forming a stamp member from a rubber material which has a low rebound characteristic and low compressibility; (2) preparing a plurality of stamping inks of different colors, each of the stamping inks having a relatively high viscosity and low flowability; (3) diluting the stamping inks with a diluent to increase their flowability and permeability; (4) placing a plurality of ink-absorbing members in a side-by-side adjacent arrangement and isolating them from one another in order to prevent fluid communication; (5) adding the diluted stamping inks into the ink-absorbing members respectively; (6) saturating the stamp member with a highly volatile liquid; (7) disposing the stamp member on the ink-absorbing members to transfer the diluted stamping inks from the ink-absorbing members to the stamp member so as to have the stamp member formed with regions of different colors, the highly volatile liquid assisting the infiltration of the diluted stamping inks into the stamp member upon vaporizing from the stamp member; and (8) heating the stamp member to remove the diluent present in the diluted stamping inks.

12 Claims, 3 Drawing Sheets

METHOD FOR PRODUCING A STAMP

BACKGROUND OF THE INVENTION

1. Field of the Invention

This invention relates to a method for producing a stamp, more particularly to a manufacturing method for producing a stamp with a plurality of differently colored regions that are formed on a stamp member of the stamp and that can present a colorful pattern when the stamp is in use.

2. Description of the Related Art

This invention is an improvement of a conventional stamp, more particular to a conventional stamp which is used by children or students for pressing or printing onto a surface a cartoon pattern without the need of a stamp pad. It is noted that the stamp member of the conventional stamp can only present a pattern of a single color. Accordingly, children easily tire of the conventional stamp

SUMMARY OF THE INVENTION

Therefore, the main objective of this present invention is to provide a manufacturing method for producing a stamp with a plurality of differently colored regions that are formed on a stamp member of the stamp and that can present a colorful pattern when the stamp is in use.

According to this invention, a manufacturing method for a stamp includes the following steps:

(1) forming a stamp member from a rubber material, the stamp member having a low rebound characteristic and low compressibility;

(2) preparing a plurality of stamping inks of different colors, each of the stamping inks comprising 55 to 75% by weight of glycerine, 10 to 15% by weight of a water soluble dye, 20 to 30% by weight of poly vinyl pyrrolidone, and 2 to 10% by weight of lanolin, the stamping inks having a viscosity of 51000 cps;

(3) diluting the stamping inks with a diluent in order to increase flowability and permeability of the diluted stamping inks, wherein the diluent is water and the weight ratio of the diluent and the stamping inks is about 6:1, the diluted stamping inks having a viscosity of 1500 cps;

(4) placing a plurality of ink-absorbing members in a side by side adjacent arrangement and isolating them from one another in order to prevent fluid communication, wherein the ink-absorbing members are made of sponge;

(5) adding the diluted stamping inks into the ink-absorbing members respectively;

(6) saturating the stamp member with a highly volatile liquid, such as methanol;

(7) disposing the stamp member on the ink-absorbing members in order to transfer the diluted stamping inks from the ink-absorbing members to the stamp member so as to form the stamp member with regions of different colors, the highly volatile liquid assisting infiltration of the diluted stamping inks into the stamp member upon vaporizing from the stamp member, the amount of the diluted stamping inks absorbed by the stamp member being 80 to 100% of the saturation amount of the stamp member; and then (8) heating the stamp member at a temperature of 105° C. so as to remove the diluent present in the diluted stamping inks while retaining the stamping inks with an amount of 12 to 18% of the total original amount absorbed by the stamp member.

BRIEF DESCRIPTION OF THE DRAWINGS

Other features and advantages of the present invention will become apparent in the following detailed description of a preferred embodiment of this invention, with reference to the accompanying drawings, of which.

DETAILED DESCRIPTION OF THE PREFERRED EMBODIMENT

Figure 1:
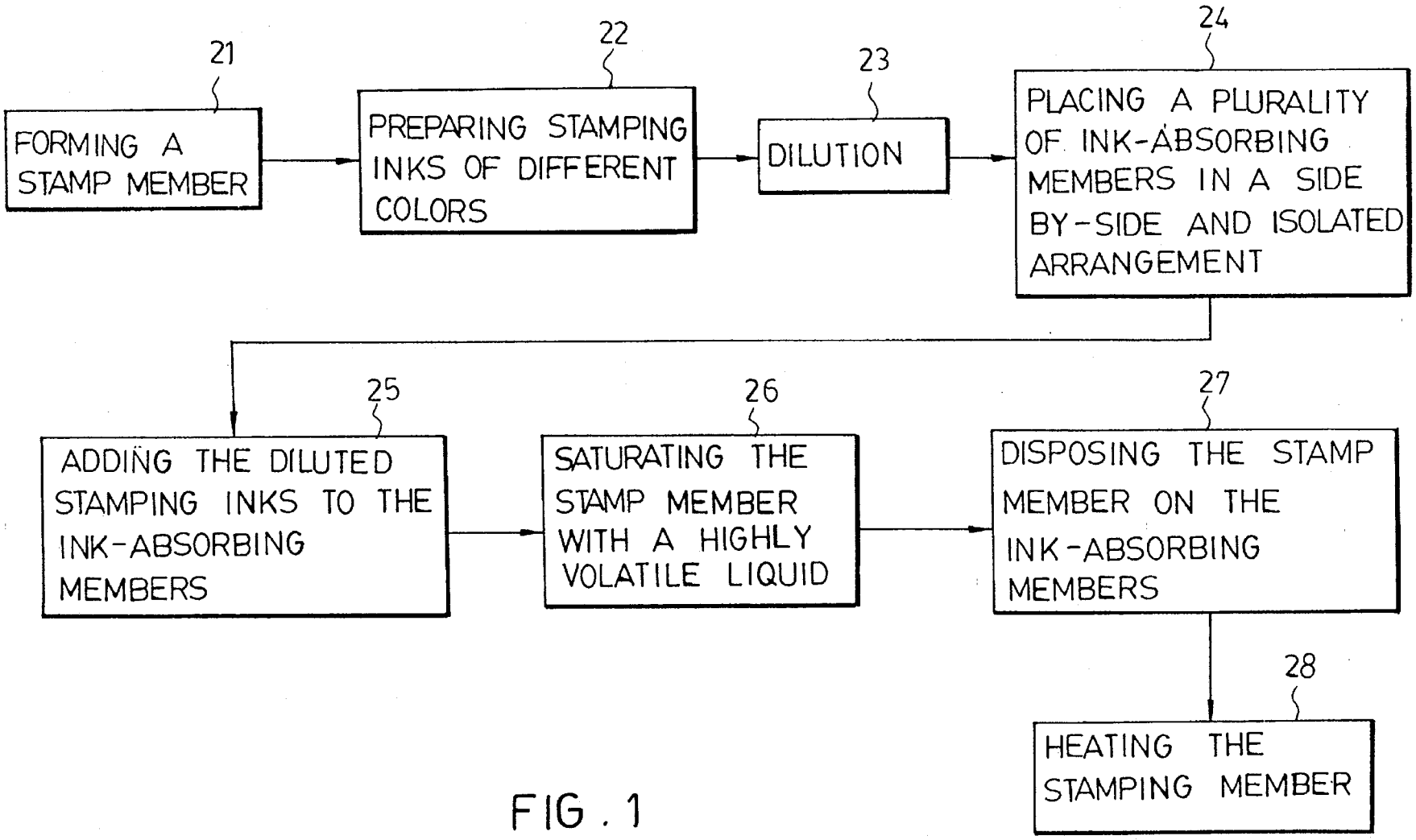
FIG. 1 is a flow diagram of a preferred embodiment of a method for producing a stamp of this invention.

FIG. 1 illustrates a flow diagram of a preferred embodiment of a method for producing a stamp of this invention. According to the flow diagram of FIG. 1, the detailed steps of the preferred embodiment of the stamp manufacturing method of this invention are described as following:

(1) forming a stamp member from a rubber material which has a low rebound characteristic and low compressibility, as shown in block 21;

(2) preparing a plurality of stamping inks of different colors, each of the stamping inks having a high viscosity and low flowability, as shown in block 22;

(3) diluting the stamping inks with a diluent to increase their flowability and permeability, as shown in block 23;

(4) placing a plurality of ink-absorbing members in a side-by-side adjacent arrangement and isolating them from one another in order to prevent fluid communication, as shown in block 24;

(5) adding the diluted stamping inks into the ink-absorbing members respectively, as shown in block 25;

(6) saturating the stamp member with a highly volatile liquid, as shown in block 26;

(7) disposing the stamp member on the ink-absorbing members to transfer the diluted stamping inks from the ink-absorbing members to the stamp member so as to form the stamp member with regions of different colors, as shown in block 27, the highly volatile liquid assisting the infiltration of the diluted stamping inks into the stamp member upon vaporizing from the stamp member; and then (8) heating the stamp member to remove the diluent present in the diluted stamping inks, as shown in block 28.

In the step (1), the rubber material for forming the stamp member is made from rubber powders which are heated at a temperature of 150° C. for about 10 minutes so as to form the rubber powders into the stamp member. In this embodiment, the rubber powders are made of acrylonitrile-butadiene rubber (NBR) and butadiene rubber (BR) by heating and pressing the latter. Each of the rubber powders has a particle size of less than 200 mesh. The stamp member made from the rubber powders has a hardness of shore c 50 and a rebound characteristic of 20%, as well as a compression set of below 30%.

In the step (2), the composition of each of the stamping inks of different colors includes 55 to 75% by weight of glycerine, 5 to 10% by weight of a water soluble dye, 20 to 30% by weight of poly vinyl pyrrolidone (PVP), and 2 to 10% by weight of lanolin. In this embodiment, 100 g glycerine, 10 g water soluble dye, 40 g poly vinyl pyrrolidone, and 5 g lanolin are mixed to form the stamping inks of different colors which have a relatively high viscosity of 51000 cps (Centipose). This high viscosity results in the low flowability of the stamping inks. The water soluble dye used to form the stamping inks is an acid dye which can include CI acid red 73, CI acid blue 73, or CI acid brown 73 etc., depending on the desired colored regions of the stamp member. The poly vinyl pyrrolidone can increase the viscosity of the stamping inks, while the lanolin can make the stamping inks permeate quickly into a paper after stamping.

In the step (3), the diluent which is added to the stamping inks is water. The weight ratio of the water and the stamping inks is 6:1. Thus, in this embodiment, about 900 ml water is added to the stamping inks. The diluted stamping inks have a viscosity of 500 cps. This viscosity can result in the increased flowability and permeability of the diluted stamping inks, which is necessary in the succeeding steps.

Figure 2:
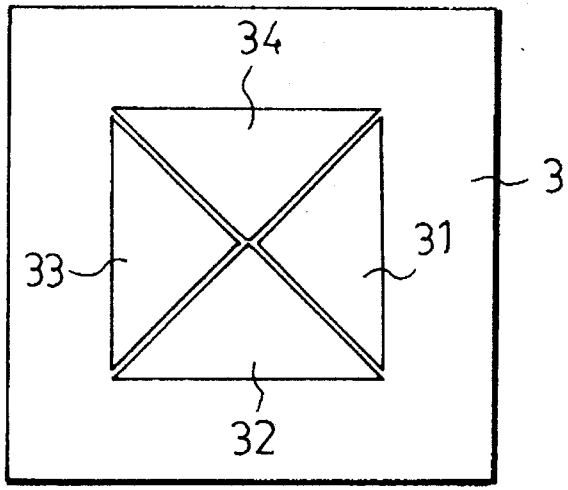
FIG. 2 is a top elevational view showing a plurality of ink-absorbing members which are disposed within a case in an isolated arrangement for use in the method of this invention.

In the step (4), there are four ink-absorbing members 31, 32, 33, 34, as shown in FIG. 2, which are disposed within a casing 3. According to this embodiment, the ink-absorbing members 31, 32, 33, 34 are made of sponge. The casing 3 is partitioned into four watertight compartments. The ink-absorbing members 31, 32, 33, 34 are disposed respectively within the watertight compartments of the casing 3 and are isolated from one another to prevent fluid communication.

In the step (5), the diluted stamping inks are added respectively into the ink-absorbing members 31, 32, 33, 34 to the saturation amount of the ink-absorbing members 31, 32, 33, 34. In this way, each of the ink-absorbing members 31, 32, 33, 34 has a respective one of the diluted stamping inks of different colors.

In the step (6), the stamp member is immersed in a highly volatile liquid. In this embodiment, the highly volatile liquid is methanol.

Figure 3:
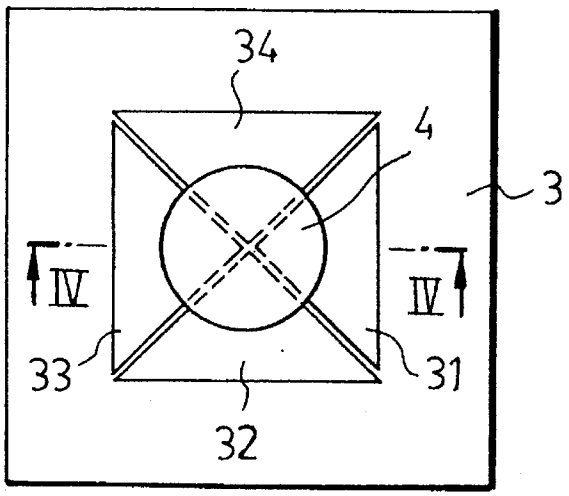
FIG. 3 is a schematic view illustrating how the stamp member of the stamp absorbs stamping inks of different colors present in the ink-absorbing members in accordance with this invention.
Figure 4:
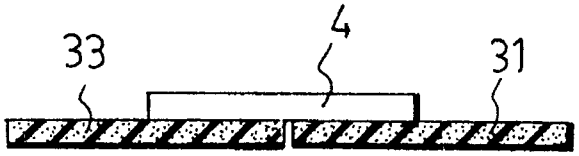
FIG. 4 is a sectional view, showing the step of disposing the stamp member on the ink-absorbing members, taken along the line IV—IV in FIG. 3.

Referring to FIGS. 3 and 4, when disposed on the ink-absorbing members 31, 32, 33, 34, as in step (7), the stamp member 4 can absorb the diluted stamping inks from the ink-absorbing members 31, 32, 33, 34 so as to form four colored regions on the stamp member 4. In addition, the methanol, which vaporizes easily from the stamp member 4, can assist in the infiltration of the diluted stamping inks into the stamp member 4. The stamp member 4 is taken away from the ink-absorbing members 31, 32, 33, 34 when the amount of the diluted stamping inks that is absorbed by the stamp member 4 is 80 to 100% of the saturation amount of the stamp member 4.

In the step (8), the stamp member 4 is heated in an oven at a temperature of 105° C. in order to remove the diluent present in the diluted stamping inks, while retaining the stamping inks with an amount of 12 to 18% of the total original amount absorbed by the stamp member 4. The stamping inks are thus concentrated and therefore have low flowability. Hence, the stamping inks in the different regions of the stamp member 4 do not mix easily with one another and are distributed uniformly in the respective region.

Figure 5:
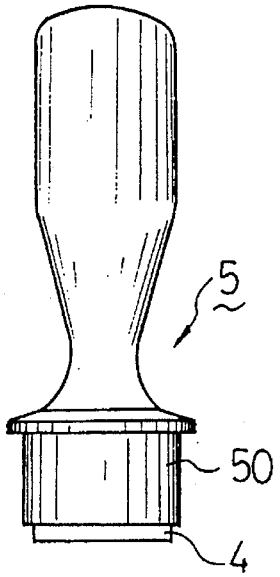
FIG. 5 is a perspective view showing a preferred embodiment of the stamp which is produced from the manufacturing method of this invention.
Figure 6:
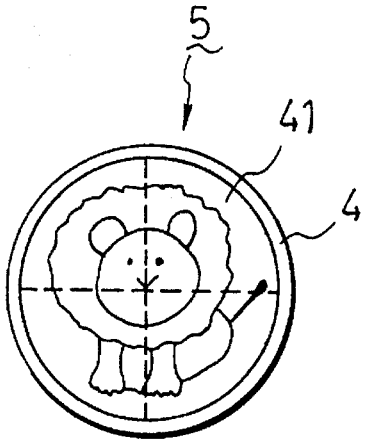
FIG. 6 is a bottom elevational view showing the preferred embodiment of the stamp according to this invention.

Referring to FIG. 5, the completed stamp member 4 is mounted on the bottom side of a base body 50 of the stamp 5 after the step (8). The bottom end surface of the stamp member 4 can be engraved with or embossed with a predetermined pattern 41, as shown in FIG. 6. Since the stamping inks of different colors can be provided in predetermined regions of the stamp member 4, the color distribution of the pattern 41 can be varied as desired. Furthermore, since the stamping inks have low flowability, the stamping inks in the regions do not mix easily with one another. The stamping inks in the stamp member 4 can properly permeate off the stamp member 4 when the stamp member 4 is depressed on a surface.

Aside from the above benefits, the stamp manufacturing method of this invention still has the following advantages:

1. Even though the stamping inks in the regions of the stamp member 4 do not mix easily with one another, they can mix slightly with one another in the boundaries of any two adjacent regions of the stamp member 4 in order to form colorful boundaries among the regions of the stamp member 4. These colorful boundaries can enhance the aesthetic effect of the pattern 41 of the stamp member 4.

2. Glycerine, which is the main composition of the stamping inks, contains three hydroxyls and therefore has a strong hygroscopicity in the air so that the stamping inks in the stamp member 4 can be maintained in a hygroscopic condition even after a long-term use.

3. The addition of the methanol in the stamp member is the best way to permit effective infiltration of the diluted stamping inks into the stamp member.

While the present invention has been described in connection with what is considered the most practical and preferred embodiment, it is understood that this invention is not limited to the disclosed embodiments but is intended to cover various arrangements included within the spirit and scope of the broadest interpretations and equivalent arrangement.

I claim:

1. A method for producing a stamp comprising the steps of:

(1) forming a stamp member from a rubber material which has a low rebound characteristic and low compressibility;

(2) preparing a plurality of stamping inks of different colors, each of said stamping inks having a high viscosity and low flowability;

(3) diluting said stamping inks with a diluent in order to increase flowability and permeability of said diluted stamping inks;

(4) placing a plurality of ink-absorbing members in a side-by-side adjacent arrangement and isolating them from one another in order to prevent fluid communication;

(5) adding said diluted stamping inks into said ink-absorbing members respectively;

(6) saturating said stamp member with a highly volatile liquid;

(7) disposing said stamp member on said ink-absorbing members in order to transfer said diluted stamping inks from said ink-absorbing members to said stamp member, thereby forming said stamp member with regions of different colors, said highly volatile liquid assisting absorption of said diluted stamping inks into said stamp member upon vaporizing from said stamp member; and then (8) heating said stamp member to remove said diluent present in said diluted stamping inks.

2. A method for producing a stamp as claimed in claim 1, wherein said rubber material for forming said stamp member is made from rubber powders which are heated at a temperature of 150° C. for about 10 minutes so as to form said rubber powders into said stamp member.

3. A method for producing a stamp as claimed in claim 2, wherein said rubber powders for forming said rubber material are made of acrylonitrile-butadiene rubber and butadiene rubber.

4. A method for producing a stamp as claimed in claim 1, wherein said highly volatile liquid is a methanol.

5. A method for producing a stamp as claimed in claim 1, wherein each of said stamping inks, prior to dilution in step (3), comprises 55 to 75% by weight of glycerine, 5 to 10% by weight of a water soluble dye, 20 to 30% by weight of poly vinyl pyrrolidone, and 2 to 10% by weight of lanolin, said stamping inks having a viscosity of 51000 cps.

6. A method for producing a stamp as claimed in claim 5, wherein said water soluble dye is an acid dye.

7. A method for producing a stamp as claimed in claim 1, wherein said diluent is water.

8. A method for producing a stamp as claimed in claim 7, wherein a weight ratio of said diluent and said stamping inks in step (3) is about 6:1.

9. A method for producing a stamp as claimed in claim 8, wherein said diluted stamping inks have a viscosity of 1500 cps.

10. A method for producing a stamp as claimed in claim 1, wherein the amount of said diluted stamping inks absorbed by said stamp member is 80 to 100% of the saturation amount of said stamp member.

11. A method for producing a stamp as claimed in claim 1, wherein said ink-absorbing members are made of sponge.

12. A method for producing a stamp as claimed in claim 1, wherein said stamp member is heated at a temperature of 105° C. so as to remove said diluent present in said diluted stamping inks while retaining said stamping inks with an amount of 12 to 18% of the total original amount absorbed by said stamp member.

* * * * *